US005934720A

United States Patent [19]

Karalius

[11] Patent Number: 5,934,720

[45] Date of Patent: Aug. 10, 1999

[54] LOW PROFILE RELEASE MECHANISM FOR ELECTRIC DOOR STRIKE

[75] Inventor: Kristin F. Karalius, Phoenix, Ariz.

[73] Assignee: Hanchett Entry Systems, Inc., Phoenix, Ariz.

[21] Appl. No.: 08/972,205

[22] Filed: Nov. 17, 1997

[51] Int. Cl.[6] ..... E05B 15/02

[52] U.S. Cl. ..... 292/341.16; 292/201

[58] Field of Search ..... 292/341.16, 341.17, 292/152, 201, DIG. 71, 341.15, 153

[56] References Cited

U.S. PATENT DOCUMENTS

| | | | |
|---|---|---|---|
| 3,521,921 | 7/1970 | Miyazaki | 292/201 |
| 3,638,984 | 2/1972 | Davidson | 292/201 |
| 3,640,560 | 2/1972 | Zawadzki et al. | 292/201 |
| 3,910,617 | 10/1975 | Scalza et al. | 292/341.16 |
| 4,471,983 | 9/1984 | Bischoff et al. | 292/341.16 |
| 4,595,220 | 6/1986 | Hanchett, Jr. et al. | 292/341.16 |
| 4,867,496 | 9/1989 | Thomas | 292/341.16 |
| 4,917,425 | 4/1990 | Logas | 292/341.16 |
| 4,986,584 | 1/1991 | Logas | 292/341.16 |
| 5,076,625 | 12/1991 | Oxley | 292/201 |
| 5,118,150 | 6/1992 | Jarrett | 292/341.16 |
| 5,127,691 | 7/1992 | Herron et al. | 292/341.16 |
| 5,484,180 | 1/1996 | Helmar | 292/341.16 |
| 5,490,699 | 2/1996 | Uyeda | 292/341.16 |

FOREIGN PATENT DOCUMENTS

| | | | |
|---|---|---|---|
| 1021024 | 2/1953 | France | 292/201 |

*Primary Examiner*—Steven Meyers
*Assistant Examiner*—Stephen Grady
*Attorney, Agent, or Firm*—Warren F.B. Lindsley

[57] ABSTRACT

A low profile electric door strike latching mechanism for installing in a door jamb wherein the strike comprises a face plate, a latch bolt cavity, a keeper bar and a two part housing. The keeper bar in its closed or latched condition is held immobile to enclose one side of the cavity. When the latching mechanism is unlocked, the person opening the door applies pressure to the latch bolt causing the keeper bar to pivot thereby releasing the latch bolt and allowing the door to be opened.

6 Claims, 2 Drawing Sheets

LOW PROFILE RELEASE MECHANISM FOR ELECTRIC DOOR STRIKE

BACKGROUND OF THE INVENTION

Electric door strikes are commonly used in various places of business where it is desired to control entry into a secured area by means of a remote switch. As an example, the lobby of a building might be separated from the rest of the facility by a door that is secured by an electric door strike. When an individual or group of individuals have been cleared for entry into the main part of the building, the receptionist or security guard depresses a momentary switch causing the door strike to be unlocked for a set period of time. The door strike then returns automatically to the locked condition.

While electric door strikes are quite commonly available for such applications, it is frequently found that certain door jam constructions do not provide sufficient space to accommodate a conventional electric door strike. This is especially true in the case of internal limited access applications which employ a wide variety of architectural treatments. As an example, the area might be secured by means of a plate glass door and adjoining glass panels with very limited metal hardware securing them together, in which case a heavy or bulky door jam would detract from the overall design.

The present invention comprises a particularly compact door strike construction in a low profile configuration that fits comfortably within a very shallow door jamb.

SUMMARY OF THE INVENTION

In accordance with the invention claimed, a new and improved door strike construction is provided for use in electric door strike installations.

It is, therefore, one object of this invention to provide an improved door strike mechanism in a low profile design that will fit into a door jam that is too shallow to accommodate a conventional electrically energized door lock release mechanism.

Another object of this invention is to provide such a low profile electric door strike in a compact yet robust construction that does not sacrifice strength and integrity as a trade-off for miniaturization.

A further object of this invention is to provide such a low profile electric door strike in a very simple construction that employs a minimum number of inexpensive components.

A still further object of this invention is to provide in such a low profile door strike effective means for preventing the lock from being picked.

A still further object of this invention is to achieve such a low profile configuration while incorporating an internal solenoid for direct control of the release mechanism.

Yet another object of this invention is to provide such an improved electric door strike in a pleasing and attractive external form.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE EMBODIMENT

Referring more particularly to the drawings by characters of reference, FIGS. 1–7 disclose the improved low profile electric door strike 10 of the invention.

Figure 1:
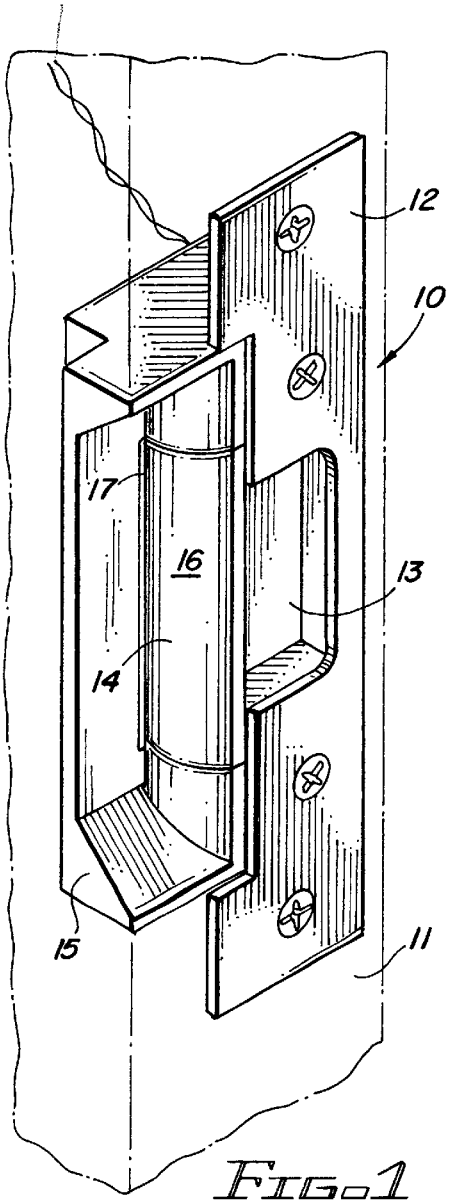
FIG. 1 is a perspective view of the low profile electric door strike of the invention as installed in a door jamb.

FIG. 1 shows the strike 10 as installed in a door jamb 11 with the jam represented as transparent in order to reveal the outlines of the door strike. As shown in FIG. 1, the strike 10 comprises a face plate 12, a latch bolt cavity 13, a pivoting keeper bar 14 and a molded or cast metal housing 15. The keeper bar 14 is shown in the closed or locked condition for which the latch bolt is trapped or retained inside the cavity 13. When the latching mechanism is unlocked, a person opening the door applies pressure to the latch bolt against the keeper bar 14 causing the keeper bar to pivot out of the way, releasing the latch bolt and allowing the door to be opened.

The latching mechanism is completely enclosed and inaccessible so that it cannot be picked. For this purpose, the keeper bar 14 has a curved outer surface 16 that is radially equidistant from the pivot pin of the keeper bar 14. This allows a very small spacing 17 for clearance between the pivoting keeper bar 14 and the housing 15.

Figure 2:
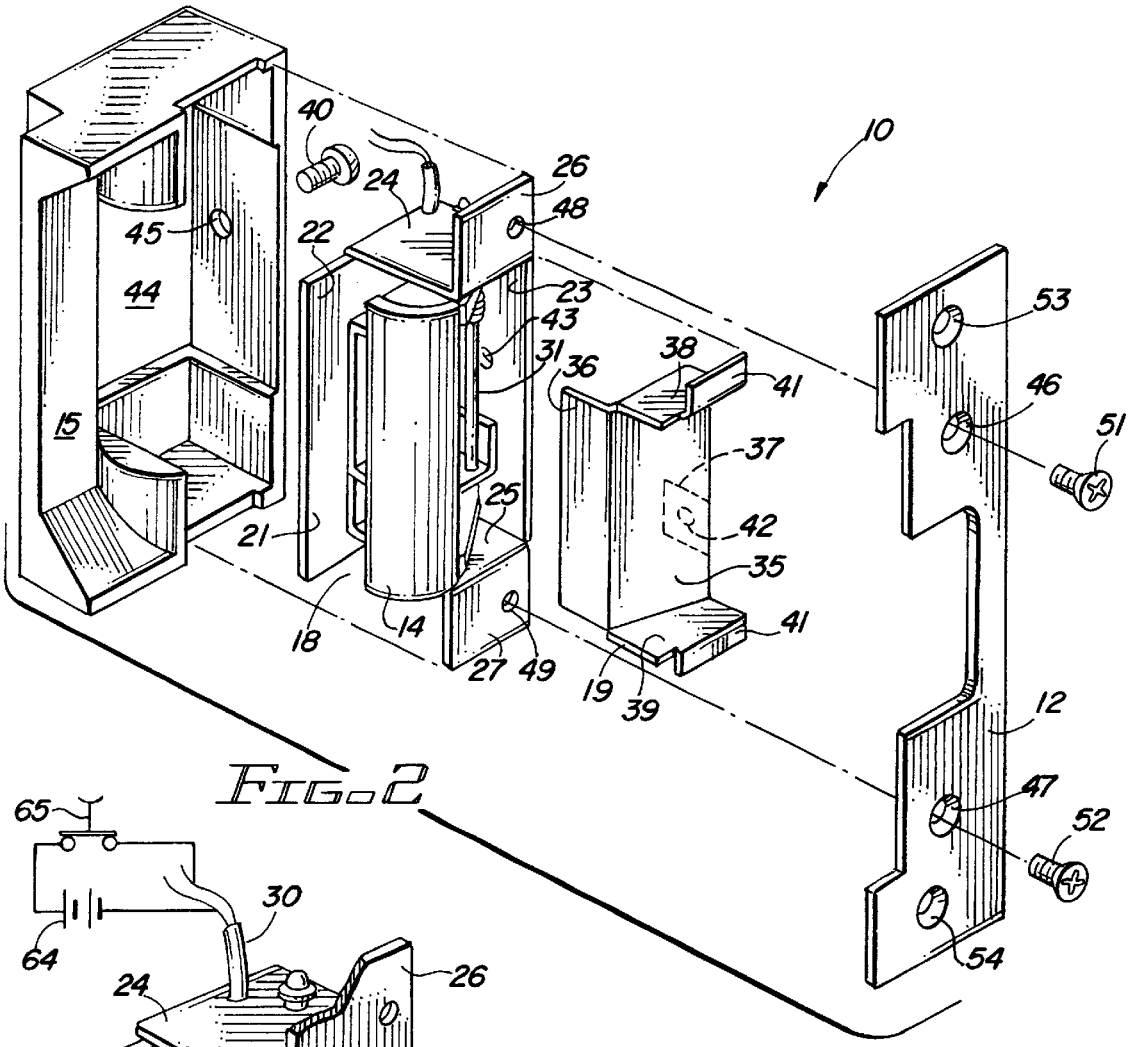
FIG. 2 is an exploded view of the electric door strike of the invention showing the various components of the strike.

As shown in the exploded view of FIG. 2, the strike 10 comprises the molded or cast metal housing 15, a release mechanism 18, a solenoid cover 19 and the face plate 12.

The housing 15 comprises an artistically contoured framework which serves as a housing for the containment of the release mechanism 18. Together with the solenoid cover 19 it conceals internal parts and prevents unwanted access to the release mechanism, thereby preventing the lock from being picked.

The release mechanism 18 contains the two active components of the strike 10, these components comprising a solenoid 20 (shown most clearly in FIG. 7) and the pivoting keeper bar 14, both of which are mounted in a sturdy metal housing 21 which may be formed from a single stamping preferably of stainless steel.

As shown, the housing 21 has a rectangular base member 22, a rectangular side member 23 and upper and lower end members, 24 and 25 respectively. The end members are formed by narrow straps extending forward at right angles from the upper and lower edges of the base member 22. Mounting tabs 26 and 27 are formed at the ends of the narrow straps by bending each strap outwardly, again at right angles.

Figure 7:
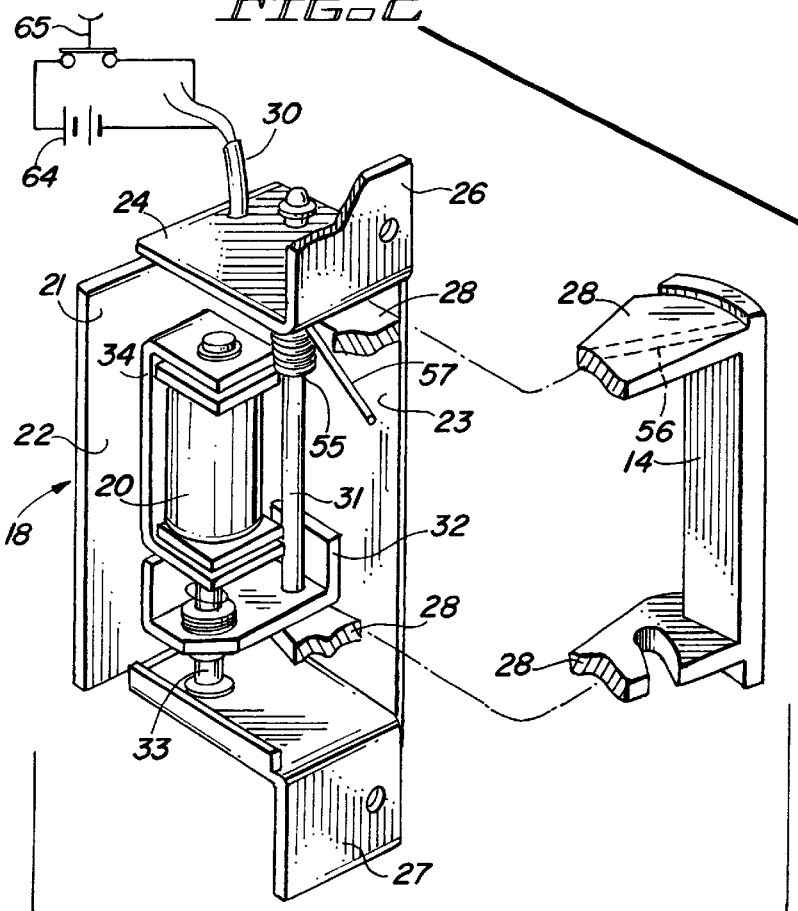
FIG. 7 is a perspective view of the release mechanism of the invention with the keeper shown broken away to reveal details of construction.

As shown in FIGS. 2 and 7, the keeper bar 14 has a perpendicularly extending arm 28 at each end. The ends of the arms 28 are pivotally mounted to a pivot pin 31 which passes through the upper and lower end members 24 and 25 of housing 21. The lower end of the pivot pin also extends through a mounting bracket 32 which slidably secures extending plunger 33 of solenoid 20 to base member 22 and side member 23. A second bracket 34 secured to base member 22 completes the mounting of solenoid 20 to housing 21.

As FIG. 7 indicates, the solenoid 20 fits inside (between) the arms 28 of pivoting keeper 14 in a very compact arrangement that plays an important role in the realization of the low profile characteristic of the electric door strike 10 of the invention.

The solenoid cover 19 completes the enclosure of the release mechanism 18. Cover 19 is formed from a single metal stamping. It has a sloping face 35 that forms the bottom of latch bolt cavity 13. Directed rearwardly from face 35 is a full-length stabilizing tab 36 that extends along one side and a fastener tab 37 at the opposite side. Forwardly extending faces 38 and 39 at the upper and lower ends, respectively, of face 35 form the upper and lower walls of cavity 13. Faces 38 and 39 also limit the return position of the keeper bar 14 to the position shown in FIG. 1 in which the outer edge of bar 14 is flush with the outer surface of face plate 12. Outwardly extending tabs 41 further stabilize the position of cover 19 and seal off the upper and lower edges of cavity 13.

Face plate 12 serves the dual purpose of securing the various components together as a sturdy unitized structure while at the same time providing an attractive cover for the internal components of the door strike.

The assembly of the strike 10 proceeds as follows:

Solenoid cover 19 is first inserted into release mechanism 18. In its installed position, cover 19 fits inside the arms 28 of keeper bar 14 with tab 36 covering one side of solenoid 20. At the opposite side a hole 42 in fastener tab 37 is aligned with a screw hole 43 in side member 23 of sturdy metal frame housing 21.

After cover 19 has been installed in mechanism 18 as just described, the cover and mechanism assembly is installed in housing 15. When installed in housing 15, the base member 22 of sturdy metal frame housing 21 fits inside a rectangular opening 44 in the back side of housing 15, effectively sealing off the back side of housing 15. As shown in FIG. 7, solenoid leads 30 pass through a hole in the upper end member of sturdy metal frame housing 21. These leads pass through a hole (not shown) in the upper end of housing 15 for connection to a power source and control means. The position of mechanism 18 and cover 19 inside housing 15 is secured by means of a machine screw 40 that passes through a hole 45 in housing 15 and threads into screw hole 43 of sturdy metal frame housing 21. When fully installed, the machine screw also passes through hole 42 of the cover, thereby retaining cover 19 in its proper position.

The final step in the assembly consists in securing face Plate 12 to the already-assembled housing 15, mechanism 18 and solenoid cover 19. As shown in the exploded view of FIG. 2, two holes 46 and 47 of face plate 12 are aligned with two threaded holes 48 and 49 in mounting tabs 26 and 27 of sturdy metal frame housing 21. Cover plate 12 is secured to housing 21 by means of two screws 51 and 52. Screw 51 passes through hole 46 and threads into hole 48, and screw 52 passes through hole 47 and threads into hole 49. Face plate 12 is now seen to be securely fixed to release mechanism 18 with solenoid cover 19 clamped between plate 12 and mechanism 18 while mechanism 18 is secured to housing 15 by virtue of its close fit within housing 15 and by means of the screw 40 that passes through hole 45 of housing 15 and threads into hole 43 of housing 21.

Two additional screw holes 53 and 54 near the upper and lower ends of face plate 12 are employed to secure the door strike to the jamb 11 as shown in FIG. 1.

FIGS. 3 through 7 disclose additional details of construction which combine to produce the particularly compact release mechanism that is needed for a low profile door strike.

The general arrangement of the solenoid 20 and the keeper bar 14 is best illustrated by FIG. 7 where the solenoid 20 is seen to be mounted in close proximity with the keeper bar 14 in a parallel orientation therewith. Furthermore, the solenoid is positioned between the arms 28 of the keeper bar 14 and the solenoid plunger 33 is parallel with the pivot pin 31 of the keeper bar 14.

The keeper bar is urged toward a closed or return position by a torsion spring 55. (The return direction is a counter-clockwise rotation of the keeper bar 14 about the pivot pin 31 as viewed from above the mechanism 18 in FIG. 7.) For this purpose, a ledge 56 is provided on the inside surface of the upper arm 28 of the keeper bar. The arm 57 of spring 55 bears against ledge 56 to urge bar 14 in the counter-clockwise direction.

Figure 3:
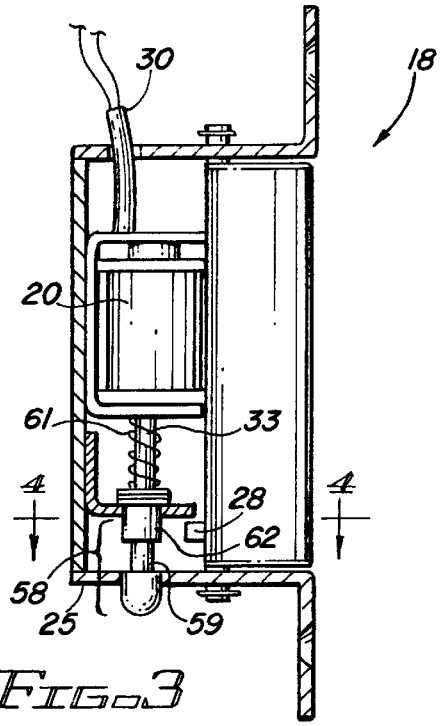
FIG. 3 a side view of the release mechanism of the electric door strike of the invention showing the locked condition of the mechanism.
Figure 4:
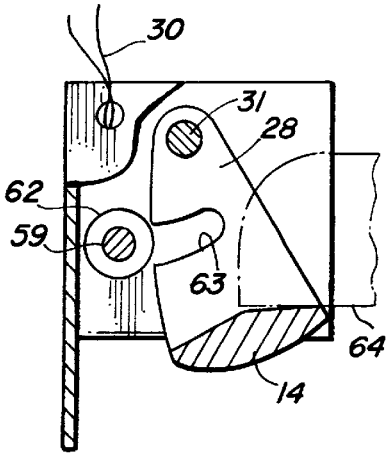
FIG. 4 is a cross-sectional view of the release mechanism taken along line 4—4 of FIG. 3.
Figure 6:
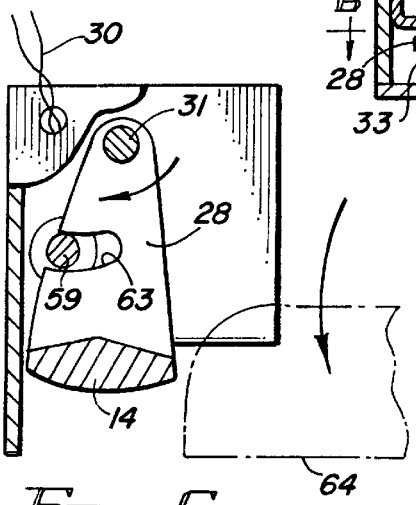
FIG. 6 is a cross-sectional view of the release mechanism taken along line 6—6 of FIG. 5.

As shown in FIG. 3, the solenoid plunger 33 has an enlarged diameter at its lower end 58 except for a reduced diameter annular groove 59 that is cut into a part of the enlarged diameter portion. The enlarged lower end 59 of plunger 33 passes through clearance holes in bracket 32 and in member 25 of sturdy metal frame housing 21. When the solenoid 20 is not energized and plunger 33 is driven to an extended position by its bias spring 61, the enlarged diameter segment 62 of plunger 33 is aligned with lower arm 28 of keeper bar 14. As shown in the cross-section view of FIG. 4, lower arm 28 has a curved slot 63 that is wide enough to receive the annular groove 59 of plunger 33 but is not wide enough to receive the enlarged diameter segment 62. Thus, as shown in FIG. 4, the rotation of the keeper bar is effectively blocked short of the release position and the latch bolt 64 is trapped behind bar 14 in the secured or locked position of the door strike.

Figure 5:
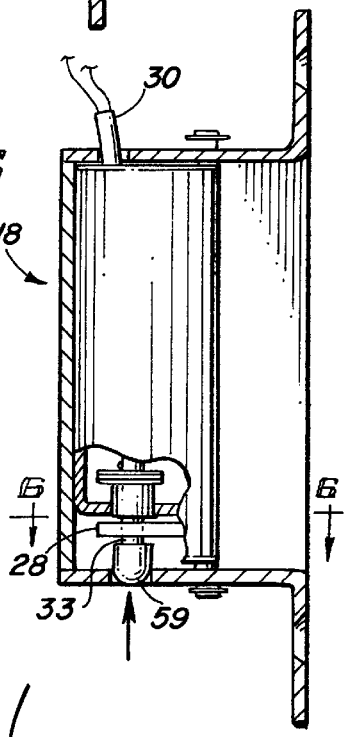
FIG. 5 is a side view of the release mechanism of the electric door strike of the invention showing the unlocked condition of the mechanism.

When the solenoid is energized, the plunger 33 is withdrawn as shown in FIG. 5, in which case the reduced diameter annular groove 59 is aligned with keeper arm 28. As shown in the cross-sectional view of FIG. 6, the curved slot 63 of arm 28 now receives the reduced diameter segment 59 of plunger 33 so that sufficient additional rotation of keeper bar 14 is enabled to free the latch bolt, thereby effecting the release or unlocked condition of the door strike.

As shown in FIG. 7, a very simple control means for the door strike 10 may comprise a direct current source or battery 64 and a momentary switch 65; serially connected with the leads 30 of the solenoid 20. The switch 65 is normally open and is closed by the receptionist or security person to release the strike.

As noted above, the strike 10 is released when the solenoid is energized and is locked or secured when the solenoid is not energized. Thus, if there is a power failure and no voltage is available to energize the solenoid, the strike is held in the secured position. This is known as a "fail secure" door strike, i. e. the door is locked or secured during a power failure.

The invention is also adaptable to function as a "fail safe" release mechanism which, by definition assumes an open or unlocked state during a power failure. The strike can readily be converted to a "fail safe" version simply by reversing the positions of the large diameter portion and the small diameter portion of the solenoid plunger so that when the solenoid is not energized, the keeper arm is aligned with the small diameter Portion of the plunger which allows the strike to be opened. In this case, the solenoid must be energized to lock or secure the strike.

Alternatively, the strike may be converted to a "fail safe" strike by retaining the original positions of the large diameter and small diameter portions of the plunger but substituting a solenoid of a type that is commonly known as a "push type". This type of solenoid extends its plunger when energized and withdraws it when deenergized. Thus, when power is lost, the plunger is withdrawn, the keeper arm is aligned with the small diameter portion of the plunger and the strike is unlocked.

In an early implementation of the invention, a low profile door strike was obtained that can be installed in a cavity only one and three fourths inches wide and one inch deep. The simplicity of the design and the low number of working parts results in low cost and reliability in accordance with the stated objects of the invention. Although but a single embodiments of the invention has been illustrated and described, it will be apparent to those skilled in the art that various changes and modifications may be made therein without departing from the spirit of the invention or from the scope of the appended claims.

What is claimed is:

1. A release mechanism for a low profile electric door strike, said release mechanism comprising:

a solenoid, a keeper bar having a pair of spaced laterally extending arms, one of which defines a curved slot therein, a housing for receiving said solenoid, said keeper bar being pivotally mounted in said housing between said arms in parallel relationship to said solenoid, spring means for biasing said keeper bar toward a closed or secured condition of said electric door strike, said solenoid having a plunger concentric with the longitudinal axis of said solenoid is spring biased to a first position when said solenoid is deenergized and magnetically moved to a second position when said solenoid is energized, said plunger having an enlarged diameter portion and a reduced diameter portion along its length, said enlarged portion having a diameter too large to penetrate said curved slot in said keeper bar and said reduced diameter portion being small enough to be received by said curved slot in said keeper bar, whereby when said slot aligns with the reduced diameter of said plunger, the strike will be unlocked and when said slot aligns with the enlarged diameter of said plunger the strike will be locked.

2. The release mechanism for said door strike as set forth in claim 1 in further combination with:

a cover for said housing, said housing comprising a sturdy metal frame, a face plate for said cover, and control means for energizing said solenoid to effect the release of said electric door strike, said cover serving together with said housing to complete the enclosure of said release mechanism, thereby forming a latch bolt cavity for the door strike, said release mechanism fitting inside said housing and secured therein by an attachment to said face plate.

3. A release mechanism for a low profile electric door strike, said release mechanism comprising:

a solenoid, a keeper bar having a pair of spaced laterally extending arms, one of which defines a curved slot therein, a housing for receiving said solenoid, said keeper bar being pivotally mounted in said housing between said arms in parallel relationship to said solenoid, spring means for biasing said keeper bar toward a closed or secured condition of said electric door strike, said solenoid having a plunger that is spring biased to a first position when said solenoid is deenergized and magnetically moved to a second position when said solenoid is energized, said plunger having an enlarged diameter portion and a reduced diameter portion along its length, said enlarged portion having a diameter too large to penetrate said curved slot in said keeper bar and said reduced diameter portion being small enough to be received by said curved slot in said keeper bar, whereby when said solenoid is deenergized said pivot arm and its slot are aligned with said enlarged portion of said extended plunger such that the pivotal travel of said keeper bar is blocked and the strike is secured thereby in its locked condition, and when said solenoid is energized said plunger is withdrawn such that said pivot arm with said slot is aligned with said reduced diameter portion of said plunger so that the pivotal travel of said keeper bar is allowed to continue to the open or released condition of said door strike as said reduced diameter portion of said plunger is received by said slot.

4. The fail secure release mechanism for said door strike as set forth in claim 3 in further combination with:

a cover for said housing, said housing comprising a sturdy metal frame, a face plate for said cover, and control means for energizing said solenoid to effect the release of said electric door strike, said cover serving together with said housing to complete the enclosure of said release mechanism, thereby forming a latch bolt cavity for the door strike, said release mechanism fitting inside said housing and secured therein by an attachment to said face plate.

5. A release machanism for a low profile electric door strike, said release mechanism comprising:

a solenoid, a keeper bar having perpendicularly extending pivot arms, one of which defines a curved slot, and a housing for said door strike, said keeper bar being pivotally mounted in said housing by means of said perpendicularly extending pivot arms, and spring biased toward a closed or secured condition of said door strike, said solenoid being mounted between said arms in said housing in close parallel relationship to said keeper bar, said solenoid having a plunger with an enlarged diameter protion and a reduced diameter portion spaced along its length, said enlarged portion having a diameter too large to be received in said curved slot while said reduced diameter portion being small enough to be received by said curved slot, whereby when said solenoid is energized said pivot arm and its curved slot are aligned with said enlarged portion of said plunger such that the pivotal travel of said keeper bar is blocked and the strike is secured thereby in its locked condition, and when said solenoid is deenergized said curved slot is aligned with said reduced diameter portion so that the pivotal travel of said keeper bar is allowed to continue to the open or released condition of said door strike as said reduced diameter portion of said plunger is received by said curved slot.

6. The fail safe release mechanism set forth in claim 5 in further combination with:

a cover for said housing, said housing comprising a sturdy metal frame, a face plate for said cover, and said cover serving together with said housing to complete an enclosure for said release mechanism, thereby forming a latch bolt cavity for the door strike, and control means for energizing said solenoid to effect release of said electric door strike, said release mechanism fitting inside said housing and secured therein by the attachment of said face plate to said housing.

* * * * *